US008464768B2

(12) United States Patent
Dammers

(10) Patent No.: US 8,464,768 B2
(45) Date of Patent: Jun. 18, 2013

(54) METHOD OF FORMING LOCKING GROOVE IN GROOVE FLANK

(76) Inventor: Dirk Dammers, Neukirchen-Vluyn (DE)

( * ) Notice: Subject to any disclaimer, the term of this patent is extended or adjusted under 35 U.S.C. 154(b) by 1120 days.

(21) Appl. No.: 11/921,839

(22) PCT Filed: Jun. 3, 2006

(86) PCT No.: PCT/EP2006/005345

§ 371 (c)(1),
(2), (4) Date: Dec. 5, 2007

(87) PCT Pub. No.: WO2006/131289

PCT Pub. Date: Dec. 14, 2006

(65) Prior Publication Data

US 2010/0154935 A1 Jun. 24, 2010

(30) Foreign Application Priority Data

Jun. 6, 2005 (DE) ..... 10 2005 026 157
Jun. 8, 2005 (DE) ..... 10 2005 026 554

(51) Int. Cl.
*B27M 1/00* (2006.01)

(52) U.S. Cl.
USPC ..... 144/371; 144/360

(58) Field of Classification Search
USPC ..... 144/357, 368, 373, 375, 356, 359, 144/360, 376, 367, 382, 392, 402, 404, 2.1, 144/3.1; 408/212, 213, 225, 227; 52/DIG. 1, 52/749.1, 749.11; 409/132
See application file for complete search history.

(56) References Cited

U.S. PATENT DOCUMENTS

| | | | | |
|---|---|---|---|---|
| 2,835,172 | A * | 5/1958 | Barker et al. | 409/144 |
| 2,915,095 | A * | 12/1959 | Pelto | 144/135.2 |
| 2,944,466 | A * | 7/1960 | Rohlfs | 409/117 |
| 4,422,239 | A * | 12/1983 | Maier et al. | 30/124 |
| 5,010,517 | A * | 4/1991 | Migita et al. | 365/114 |
| 5,025,548 | A * | 6/1991 | Justesen | 29/560 |
| 5,395,188 | A * | 3/1995 | Bailey et al. | 408/127 |
| 5,697,739 | A * | 12/1997 | Lewis et al. | 409/230 |
| 5,850,769 | A * | 12/1998 | Lund | 82/1.3 |
| 6,006,486 | A * | 12/1999 | Moriau et al. | 52/589.1 |
| 6,196,286 | B1 * | 3/2001 | Susnjara | 144/347 |
| 6,510,665 | B2 * | 1/2003 | Pervan | 52/589.1 |

(Continued)

FOREIGN PATENT DOCUMENTS

| | | |
|---|---|---|
| DE | 4184366 C | 9/1925 |
| EP | 1129825 A2 | 9/2011 |

(Continued)

*Primary Examiner* — David Walczak
*Assistant Examiner* — Jennifer C Chiang
(74) *Attorney, Agent, or Firm* — Berenato & White, LLC

(57) ABSTRACT

The invention relates to a method for machining a locking groove (9) into a groove flank (5, 6) of a panel comprising an upper and a lower side, whereby the locking groove is provided in the part of the joint groove (4) surrounded by the groove flanks, whereby the locking groove is machined by means of a rotating milling tool (12), comprising a drive (14), a milling head (13), a transmission device (11) for the rotational movement and a mounting for the milling head. The milling has a free radius (r) at least on the mounting side due to the mounting and, during the machining of the locking groove, the milling head (13) has at least a significant proportion of the free radius (r) thereof, in particular, the entirety thereof located in the part of the joint groove surrounded by groove flanks.

20 Claims, 9 Drawing Sheets

U.S. PATENT DOCUMENTS

Figure 1:
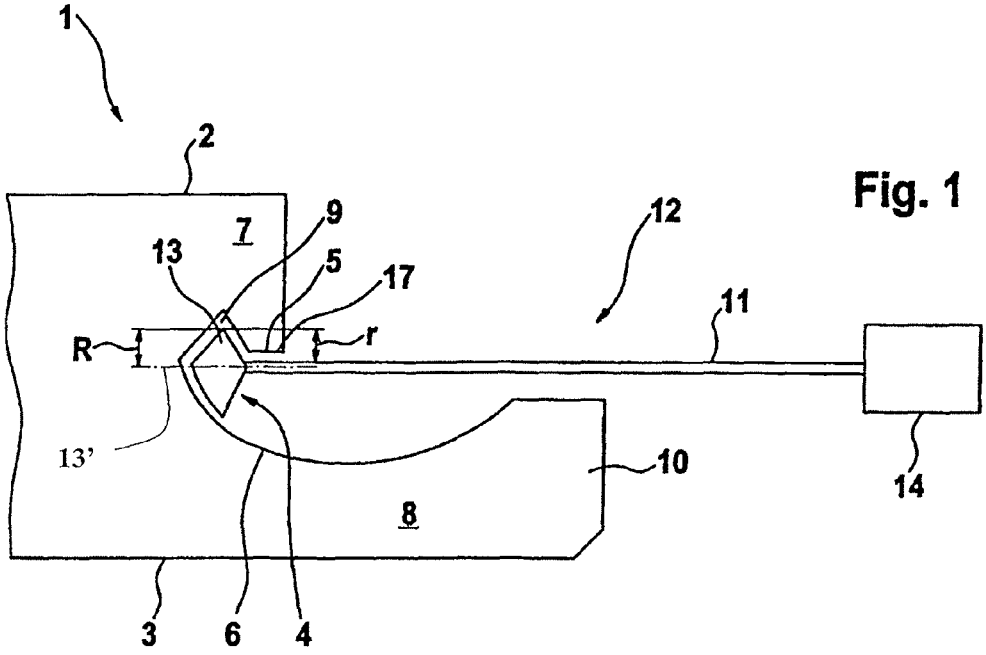

| | | | | |
|---|---|---|---|---|
| 6,568,442 | B1 * | 5/2003 | Meugniot | 144/371 |
| 6,584,747 | B2 * | 7/2003 | Kettler et al. | 52/592.2 |
| 6,592,305 | B1 * | 7/2003 | Boisvert | 409/131 |
| 6,681,820 | B2 * | 1/2004 | Olofsson | 144/368 |
| 6,851,241 | B2 * | 2/2005 | Pervan | 52/592.1 |
| 6,854,235 | B2 * | 2/2005 | Martensson | 52/601 |
| 6,898,913 | B2 * | 5/2005 | Pervan | 52/589.1 |
| 6,920,732 | B2 * | 7/2005 | Martensson | 52/586.1 |
| 7,306,411 | B2 * | 12/2007 | Mabuchi et al. | 408/230 |
| 2003/0106401 | A1 * | 6/2003 | Kowalski | 83/13 |
| 2003/0233809 | A1 * | 12/2003 | Pervan | 52/783.1 |
| 2004/0156689 | A1 * | 8/2004 | Shen | 408/212 |
| 2004/0177584 | A1 * | 9/2004 | Pervan | 52/589.1 |

FOREIGN PATENT DOCUMENTS

| | | | |
|---|---|---|---|
| RU | 2123094 | C1 | 12/1998 |
| RU | 2171877 | C2 | 8/2001 |
| RU | 33896 | U1 | 11/2003 |
| SU | 363795 | A1 | 12/1972 |

* cited by examiner

METHOD OF FORMING LOCKING GROOVE IN GROOVE FLANK

CROSS REFERENCE TO RELATED APPLICATIONS

This application is the US national phase of PCT application PCT/EP/2006/005345, filed 3 Jun. 2006, published 14 Dec. 2006 as WO 2006/131289, and claiming the priority of German patent application 102005026157.4 itself filed 6 Jun. 2005 and PCT patent application PCT/EP/2006/005345 itself filed 3 Jun. 2006, whose entire disclosures are herewith incorporated by reference.

The invention relates to a method of forming a locking groove in a groove flank of a joint groove provided in a panel, in particular a flooring panel, that is part of a tongue-and-groove joint for connecting neighboring panels, the panel having a top face and a bottom face and the locking groove being provided in the part of the joint groove that is surrounded on both sides by groove flanks.

Locking grooves are used for locking two neighboring panels. They serve to accommodate an appropriately shaped locking formation that is commonly provided on or in one of the two sides of a tongue that has been formed on the opposite lateral edge of the panel. The interfitting of two neighboring panels may, for example, be accomplished by a pivot motion and/or by an exclusively horizontal displacement.

Up to now, for example, in the case of panels in which the locking groove is provided in the groove flank of the one panel region, for example, the upper panel region, and in which the other panel region, for example, the lower panel region, is formed to protrude laterally, the locking groove is formed by exclusively by standard machining. This is accomplished using milling tools that are moved longitudinally along the edge or along which the edge of the panel is moved.

This process has the disadvantage that the use of milling tools of this type, in particular as the milling tool loses its sharpness, does not allow the desired precision in working the panels and sometimes a high degree of holding forces is necessary for holding the milling tool.

The object of the invention is therefore to prevent the disadvantages mentioned above and to provide a method that simplifies the machining of a locking groove in the groove flank.

This object is attained in that the locking groove is formed by means of a rotating milling tool including a drive, a milling head, and a support transmitting rotation from the drive to the milling head as well as a holder for the milling head, with the milling head having at its end toward the holder an effective radius r deviating from the actual radius R at least on the holder side because of the holder and, during formation of the locking groove, having at least a significant portion of its free radius r, in particular its entire free radius r, in the part of the joint groove surrounded on both sides by groove flanks. In this manner, for example, it is also possible for undercut locking grooves to be formed in a problem-free fashion by milling in an arc-shaped groove flank even in the case of a panel that has, for example, a protruding lower panel region.

Here, the free radius r determines the maximum depth of a locking groove that can be achieved because the radius of the holder must be subtracted from the actual radius R. The free radius r is between the rotation axis of the rotating milling tool and the part of the rotating milling tool that is nearest the base of the groove. When the holder is not a central shaft holding the milling head, if the holder is not central, it is also possible for a free radius r to result that is greater than the radius R of the milling head.

On the one hand, the free radius r is understood to mean the actual distance between the outer periphery of the end of the milling head closer to of the holder and the outer surface of the holder, in particular a shaft engaged in the center of the milling head. On the other hand, however, this term also includes the corresponding distances between the extended projection of the outer surface of the holder and the outer periphery of the milling head at points on the milling head that are axially distant from the holder. In this respect, in the case of a noncylindrical embodiment, different "free radii r" result along the axial extension of the milling head.

Here, the dimensions of the milling head are small; in particular, the diameter of the milling head is made small, i.e. it has a maximum of the total value that results from adding the height of the joint groove to the depth(s) of the locking groove(s), with the height of the joint groove as well as the depth of the respective locking groove being viewed orthogonally to the rotation axis of the milling head.

Here, machining of the locking groove occurs by means of relative movement between the panel and the milling head parallel to the lateral edge into which the locking groove is to be formed.

As an alternative to lateral insertion, if the milling head and, optionally, the holder have an appropriately small size, the milling head may also be inserted into the joint groove in the direction of the arrow 18 and then shifted correspondingly in a rotating fashion to create the locking groove at this point.

The holder may be formed by a support embodied in a rigid fashion, for example, as a rigid shaft, such that the support not only transmits the rotational movement to the milling head, but also holds the milling head. Naturally, the holder may also be embodied as a separate component, with the support then possibly being a drive belt or a gear wheel or toothed wheel, for example.

If the holder is embodied as a separate component, the free radius r may be greater than the actual radius R of the milling head.

Here, the locking groove is embodied as an empty area behind a protruding formation of the groove flank of the joint groove. It is obvious that the protruding formation of the groove flank need not constitute the entire rest of the groove flank. Thus, viewed in the insertion direction, before the protruding partial region, i.e. in the region of the groove flank closer to away from the base of the joint groove, another short recessed region may be provided.

The support may, for example, be made as a rigid shaft to the end of which the milling head is attached. The end of the shaft opposite the milling head is attached to the drive.

The geometry of the milling head is made in such a way that the locking groove may be formed in the groove flank with the intended shape.

During machining, the milling head is rotated by the drive. Then either the panel is moved along the milling tool longitudinally of its lateral edge or the milling tool is moved along the longitudinal edge.

Here, the general orientation of the support may be parallel as well as at an acute angle to the top or bottom face. This depends, on the one hand, on the shape of the milling head and the intended shape of the locking groove to be formed and, on the other hand, on the general structure of the lateral edge of the panel in question.

Here, the groove flanks may have different lengths from on the base of the groove and the free radius r may be located completely between the long groove flank and the short groove elongated in the projection P.

The invention further relates to a method of forming a locking groove in a groove flank of a joint groove provided in a panel, in particular a flooring panel, that is part of a tongue-and-groove joint for connecting neighboring panels, with the panel having a top face and a bottom face and the locking groove being provided in a part of the joint groove that is surrounded on both sides by groove flanks, with the groove flanks having different lengths relative to the base of the groove.

It is disadvantageous that the use of known milling tools, in particular as the milling tool loses its sharpness, does not allow the desired precision in working the panels and also that a high degree of holding forces is sometimes necessary to stabilize the milling tool.

The object of the invention is therefore to prevent the disadvantages mentioned above and provide a method that simplifies the formation of a locking groove in the groove flank of a panel whose groove flanks have different lengths relative to the base of the groove.

This object is attained in that the locking groove is formed by means of a rotating milling tool including a drive, a milling head and a support that transmits rotation from the drive to the milling head as well as a holder for the milling head, with the milling head having a free radius r at least on the side of the holder due to the holder and the milling head being located during machining of the locking groove with at least a significant portion of its free radius r, in particular its entire free radius r, between the long groove flank and the short groove flank elongated as a projection P.

The rotational axes of the milling head and drive may essentially be coaxial such that rotation of the drive occurs around the same axis as that of the milling head. In an embodiment of this sort, the support is made as a rigid shaft, for example.

At least one angle drive, in particular an angle gear and/or a flexible shaft, may be provided between the milling head and the support. One example of an angle gear would be an embodiment in the fashion of a "dentist's drill." Naturally, several angle drives may be provided for multiple deflections.

In one embodiment corresponding to a dentist's drill, the total height of the milling head and holder may also correspondingly depend on the dimensions of the joint groove and the locking groove(s), both still based on the orientation of the top face and bottom face of the panel dependent upon the angle of the rotation axis of the milling head.

Here, while the locking groove is being formed, the angle drive may be located at least significantly, in particular completely, in the joint groove surrounded by the two groove flanks.

The invention also relates to a new use of a rotating milling tool including a drive, a milling head, and a support transmitting rotation from the drive to the milling head as well as a holder for the milling head.

Milling tools of this type are used, for example, for the surface treatment of metallic work pieces or pieces of wood by chip-removing milling. Here, the milling head is rotated by the drive, with the surface of the workpiece to be treated being treated with the axial end face and/or the rotating edge of the milling head, depending on the embodiment of the milling head.

Flooring panels with a top face and a bottom face commonly have at least one joint groove that is part of a tongue-and-groove joint for connecting neighboring panels. Here, a locking groove is commonly provided in one of the two groove flanks of the joint groove in the part of the joint groove that is surrounded on both sides by the groove flanks. This additional locking groove is formed completely by milling using an appropriate tool, in particular if the locking groove is provided in the groove flank of the top panel region and if the bottom panel region is made to project laterally. This has been accomplished up to now using milling tools that are moved longitudinally along the edge of the panel and/or along which the edges of the panels are moved.

It is disadvantageous that the use of such milling tools, in particular as the milling tools lose their sharpness, does not allow the desired precision in working the panels and also that a high degree of holding forces is sometimes necessary to stabilize the milling tool.

The object of the invention is therefore to prevent the disadvantages mentioned above and to simplify the cutting of a locking groove in the groove flank of a joint groove in the part that is surrounded by groove flanks on both sides.

According to the invention, a rotating milling tool is used that includes a drive, a milling head, and a support that transfers rotation from the drive to the milling head for forming a locking groove in a groove flank of a joint groove that has been provided in a panel, in particular a flooring panel, that is part of a tongue-and-groove joint for connecting neighboring panels and with the a holder-side end of the milling head having a free radius r because of the holder and with the milling head being located during formation of the locking groove at least with a significant portion of its free radius r, in particular its entire free radius r, in the part of the joint groove that is surrounded on both sides by groove flanks.

Thus, it is also possible, for example, for undercut locking grooves to be formed in a problem-free fashion by milling in an arc-shaped groove flank even in the case of a panel that has, for example, a protruding lower panel region.

Here, the free radius r determines the maximum depth of the locking groove that may be obtained because the radius of the holder must be subtracted from the actual radius R. Insofar as the holder is not made as a central shaft holding the milling head, if the holder is not central, it is also possible for a free radius r to result that is greater than the radius R of the milling head.

On the one hand, the free radius r is understood to mean the actual distance between the outer periphery of the milling head on the side of the holder and the outer surface of the holder, in particular a shaft engaged in the center of the milling head. On the other hand, however, this term also includes the corresponding distances between the extended projection of the outer surface of the holder and the outer periphery of the milling head at points on the milling head that are axially distant from the holder. In this respect, in the case of a noncylindrical embodiment, different "free radii r" result along the axial extension of the milling head.

Here, the dimensions of the milling head are small; in particular, the diameter of the milling head is made to be small, i.e. it has a maximum of the total value that results from adding the height of the joint groove to the depth(s) of the locking groove(s), with the height of the joint groove as well as the depth of the respective locking groove being viewed orthogonally to the rotation axis of the milling head.

Here, the locking groove is cut by relative movement between the panel and the milling head along the lateral edge into which the locking groove is to be formed.

As an alternative to lateral insertion, if the milling head and, optionally, the holder have an appropriately small size, the milling head may also be inserted into the joint groove in the direction of the arrow 18 and rotatably driven to create the locking groove at this point.

The holder may be formed by a rigid support, for example, as a rigid shaft, such that the support not only transfers the rotational movement to the milling head, but also carries the milling head. Naturally, the holder may also be made as a separate component, with the drive member then possibly being a drive belt or a gear wheel or tooth wheel, for example.

If the holder is made as a separate component, the free radius r may be greater than the actual radius R of the milling head.

Here, the locking groove is formed as a free area behind a short projection from the groove flank of the joint groove. It is obvious that the projection of the groove flank need not represent all of the groove flank. Thus, viewed in the insertion direction, outward of the projection, i.e. in the region of the groove flank away from the base of the joint groove, another short recessed region may be provided.

The support or drive member may, for example, be made as a rigid shaft to the end of which the milling head is attached. The end of the shaft opposite the milling head is attached to the drive.

The geometry of the milling head is such that the locking groove may be formed in the groove flank with the intended shape.

During formation, the milling head is rotated by the drive. Then either the panel is moved along the milling tool longitudinally of its lateral edge or the milling tool is moved along the longitudinal edge.

Here, the general arrangement of the support may be parallel as well as at an angle to the top or bottom face. This depends, on the one hand, on the shape of the milling head and the intended shape of the locking groove to be formed and, on the other hand, on the general structure of the lateral edge of the panel in question.

The rotational axes of the milling head and drive may essentially be coaxial such that rotation of the drive occurs around the same axis as that of the milling head. In an embodiment of this sort, the support is a rigid shaft, for example.

At least one angle drive, in particular an angle gear and/or a flexible shaft, may be provided between the milling head and the support. One example of an angle gear would be an embodiment in the fashion of a "dentist's drill." Naturally, several angle drives may be provided for multiple deflections.

In one embodiment corresponding to a dentist's drill, the total height of the milling head and holder may also correspondingly depend on the dimensions of the joint groove and the locking groove(s), both still based on the orientation of the top face and bottom face of the panel dependent upon the angle of the rotation axis of the milling head.

Here, while the locking groove is being formed, the angle drive may be located at least significantly, in particular completely, in the joint groove surrounded by the two groove flanks.

The illustrated embodiments shown in the drawings will be explained below. Therein:

FIGS. 1-11 show various embodiments of a milling tool for carrying out the method according to the invention.

The same reference characters are used throughout the drawings for the same or similar components.

Figure 4:
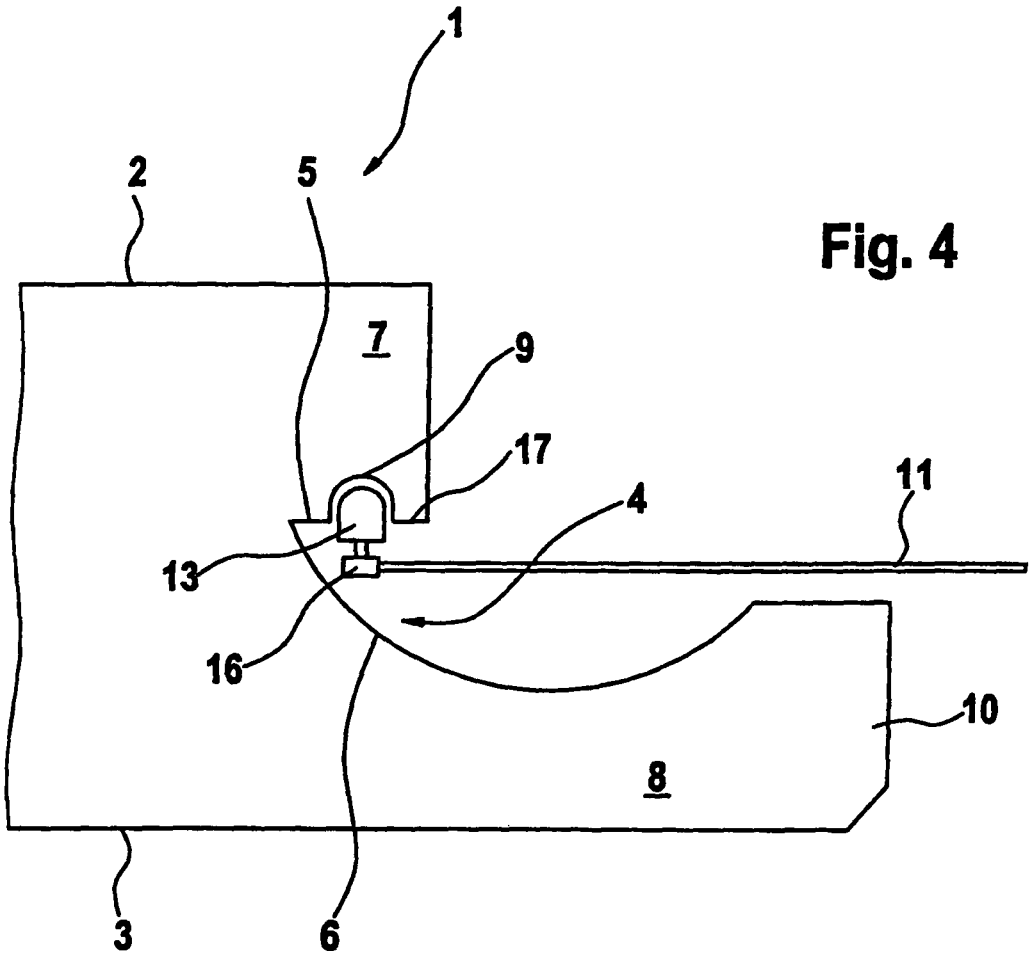
Figure 5:
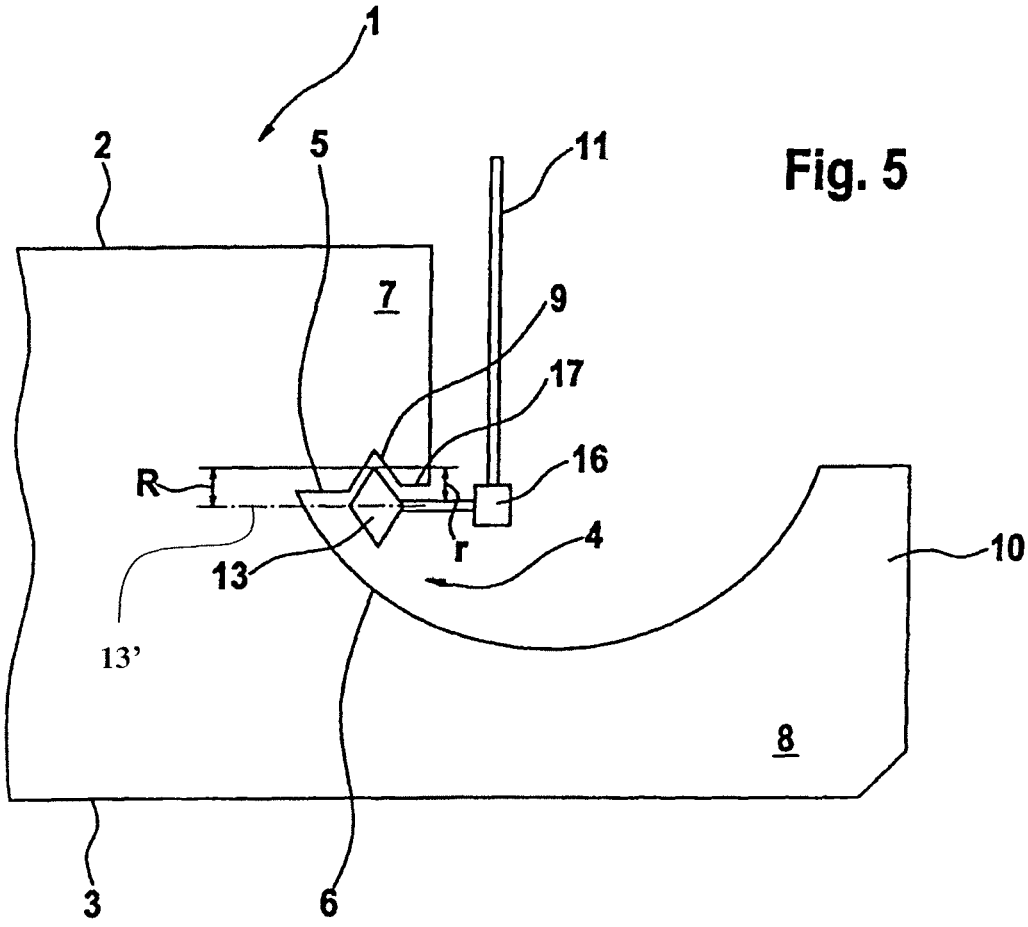
Figure 6:
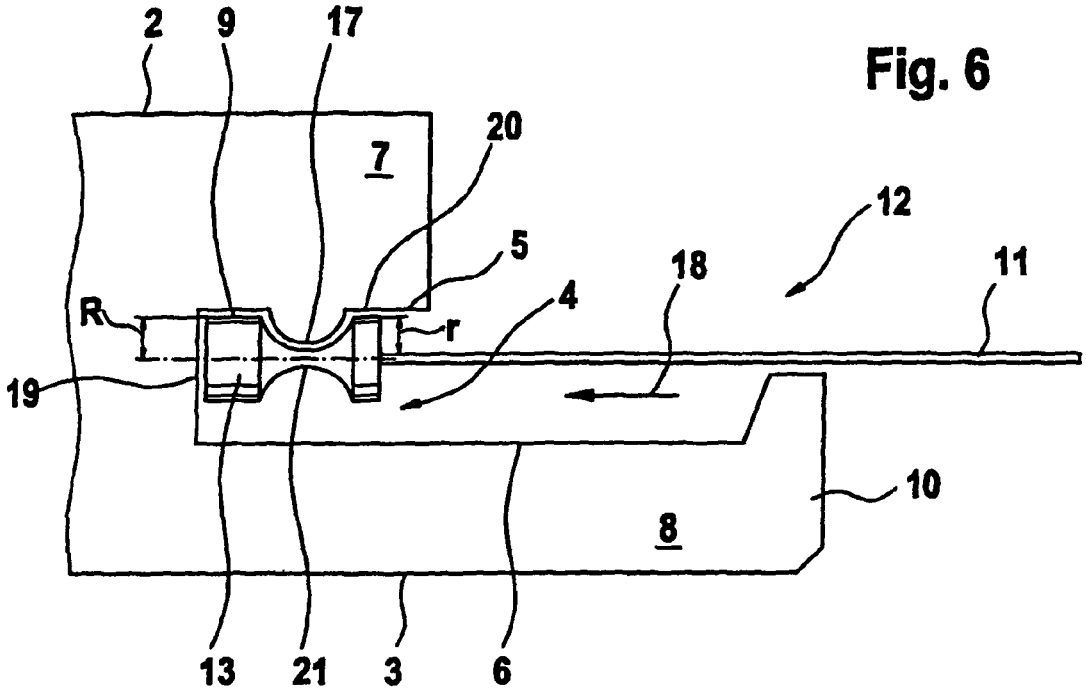
Figure 10:
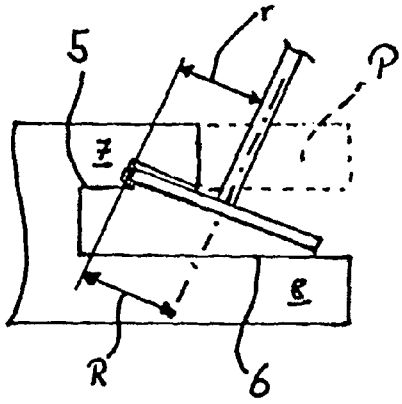
Figure 11:
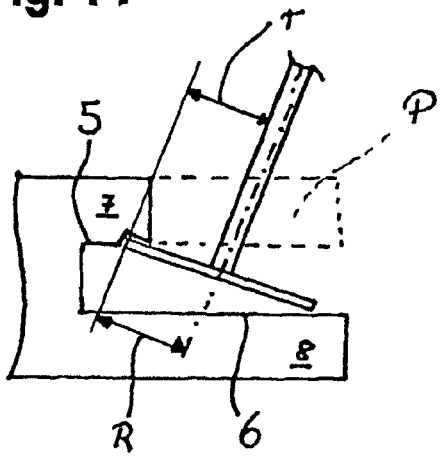

FIGS. 1 to 7 and 10 to 11 show a sectional view of a lateral edge of a panel 1. The panel 1 has a top, or first, face 2 and a bottom, or second, face 3. In the lateral edge shown here, a joint groove 4 has been provided that is defined by groove flanks 5 and 6. The joint groove 4 divides the panel 1 into upper and lower panel regions 7 and 8. In the illustrated embodiments shown, the groove flank 5 closer to the top face 2 extends approximately parallel thereto and has a locking groove 9 running parallel to the lateral edge. In FIGS. 1 to 5 and 7, the lower groove flank 6 has a shape that is arcuate toward the bottom face 3. In FIGS. 6, 10, and 11, the lower groove flank 6 is also parallel to the top face 2.

The lower panel region 8 with the arcuate or parallel groove flank 6 is shaped to project from the lateral edge past the panel region 7 and, in FIGS. 1 to 7, has a wall formation 10 projecting toward the top face 2. In the illustrated embodiments shown in FIGS. 1 to 4 and 6 and 7, the height of the wall formation 10 relative to the joint groove 4 has been selected such that even a horizontal orientation of a support 11 of a milling tool 12 is possible, as will be explained below.

The opposite lateral edge of the partially shown panel 1 is not shown. This opposite lateral edge has a tongue with one upper and one lower tongue surface, the lower tongue surface having a corresponding shape, either arcuate or parallel to the top face of the panels. A locking formation is provided on the essentially flat surface of the upper tongue surface that, in its locked state, engages in the locking groove 9 provided in the upper groove flank 5.

In the illustrated embodiments shown in FIGS. 1 to 3, 6, 7, 10, and 11, a milling tool 12 has a milling head 13 with a rotational axis 13', a support 11 formed by a rigid shaft, and a drive 14. In the illustrated embodiment shown in FIGS. 1 and 2, the milling head 13 has an outer shape approximately a triangle such that it may be used to create triangular locking grooves 9 or rhombic recesses as implied in FIG. 2. In these illustrated embodiments, the rotational axes of the milling head 13 and the drive 14 are coaxial.

In the illustrated embodiment shown in FIG. 1, the dimensions of the milling head 13 have been selected such that a locking groove 9 with a triangular cross section is produced only in the upper groove flank 5 when the milling head 13 rotating around the rotational axis 13' coaxial with the axis of the support 11 is guided perpendicularly to the rotational axis 13' of the milling head 13 along the lateral edges or the panel 1 with its lateral edge is guided along the milling tool 12 perpendicularly to the rotational axis 13' of the milling head 13.

Figure 2:
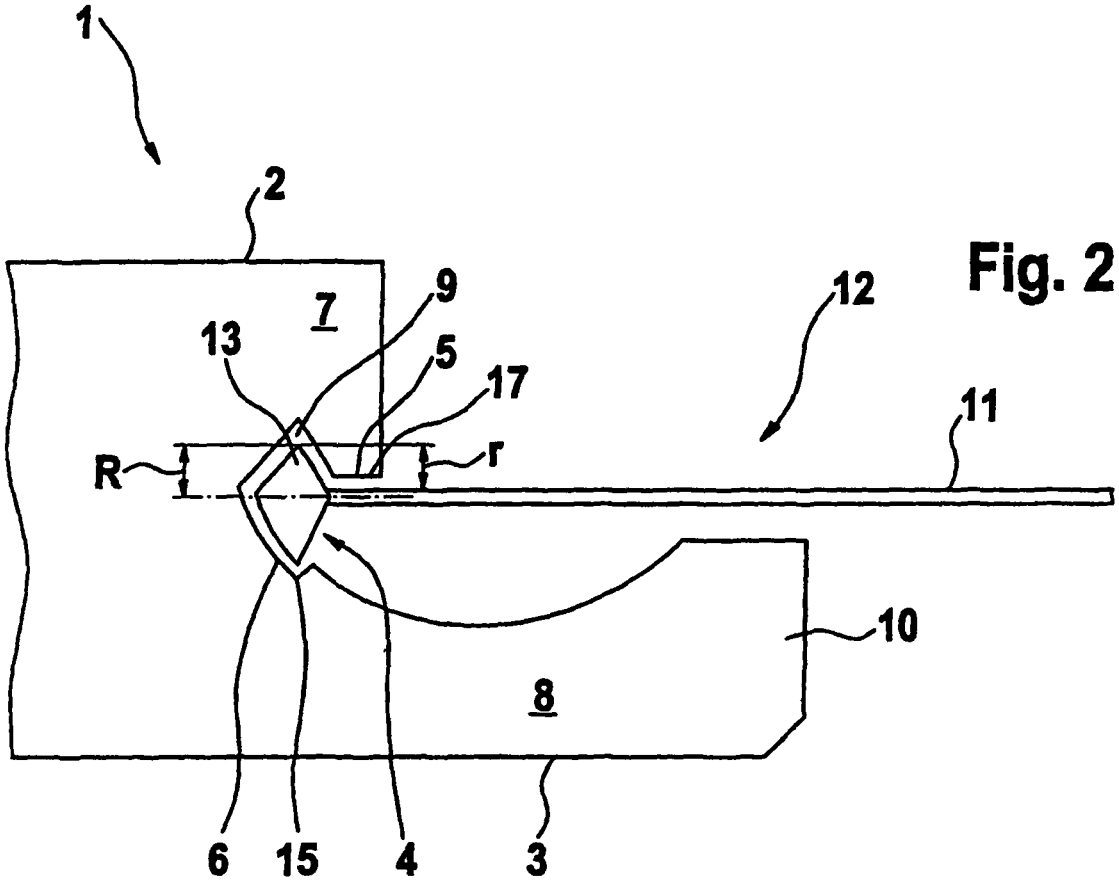

In the situation shown in FIG. 2, the milling head 13 may be used at the same time to produce a locking recess 15 in the lower groove flank 6 in addition to the locking groove 9 in the upper groove flank 5.

Figure 3:
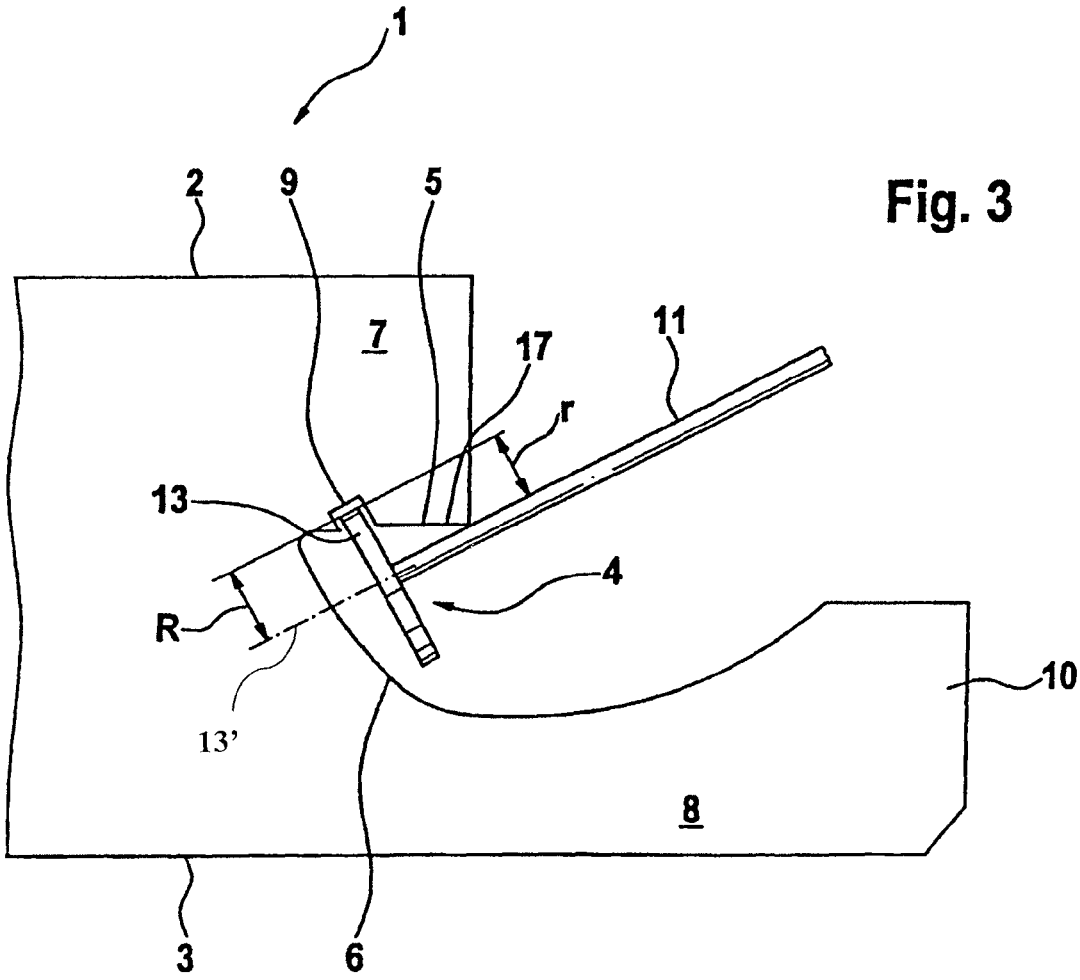

FIG. 3 as well as FIGS. 10 and 11 show an approximately rectangular outer shape of the milling head 13 such that a locking groove 9 may be produced with a correspondingly rectangular shape. As can further be seen from the figures, the axis of the support 11 may also be oriented at an acute angle to the top face 2 of the panel 1. Here, the angular orientation depends on the orientation of the planned locking groove 9.

Naturally, it is also possible for the support shown in FIGS. 1 to 3, 6, 7, 10, and 11 to also be a flexible shaft and thus have a flexible embodiment so as to be better able to orient the milling head 13.

In FIGS. 4 and 5, an embodiment is shown in which an angle drive 16 of the gear type is shown between the milling head 13 and the support 11. This embodiment also allows the formation of locking grooves 9 in panels 1 in which the wall formation 10 of the lower panel region 8 is higher than the joint groove 4 and therefore partially or completely covers the joint groove 4 as is shown in FIG. 5.

As shown in FIG. 6, the locking groove 9 is shaped as an empty region behind a protruding partial region 17 of the groove flank 5 behind the joint groove 4. Before the protruding partial region 17 viewed in the insertion direction (arrow 18), i.e. another recessed region 20 has been provided in the region of the groove flank 5 away from a joint groove base (i.e., a bottom of the joint groove 4) 19. The protruding partial region 17 has an arcuate shape. It is obvious that a groove flank 5 or 6 may have multiple projecting regions 17 oriented parallel to one another with locking grooves 9 or recessed regions 20 located therebetween.

In order to produce the embodiment shown in FIG. 6, the milling head 13 has an annular groove 21 whose shape corresponds to the shape of the protruding partial region 17. If multiple protruding partial regions 17 are desired, the milling head 13 has a corresponding number of annular grooves 21.

Naturally, it is possible to use the method according to the invention to place one or more locking groove(s) 9 in the lower and upper groove flank 6 and 5 at the same time, i.e. in one pass. In order to do so, the embodiment shown in FIG. 6 need only be adapted with regard to its dimensions. Thus, either the diameter of the milling head 13 must be correspondingly enlarged or the distance between the lower and upper groove flanks 6 and 5 must be reduced.

Figure 7:
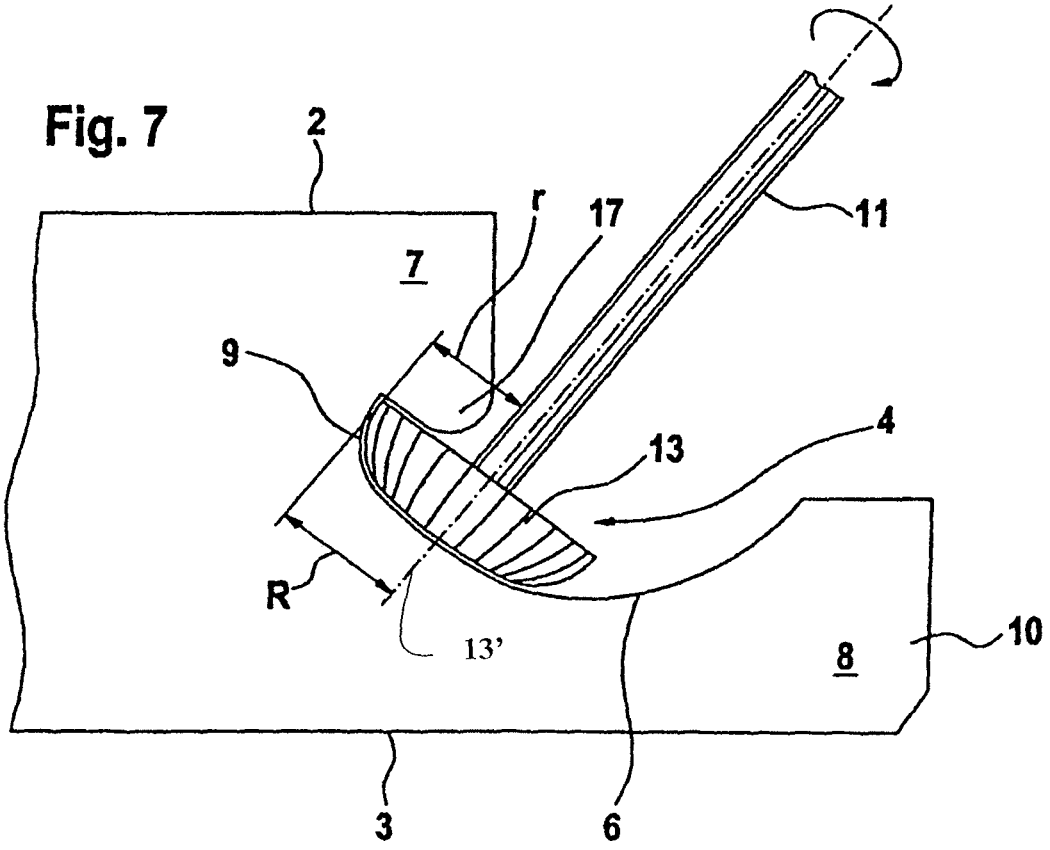

FIG. 7 shows a milling head 13 with an approximately semicircular cross section. As can be clearly be seen from the figure, during formation of the locking groove 9, a significant portion of the free radius r of the milling head 13 is located in the part of the joint groove 4 surrounded on both sides by the groove flanks 5 and 6.

Figure 8:
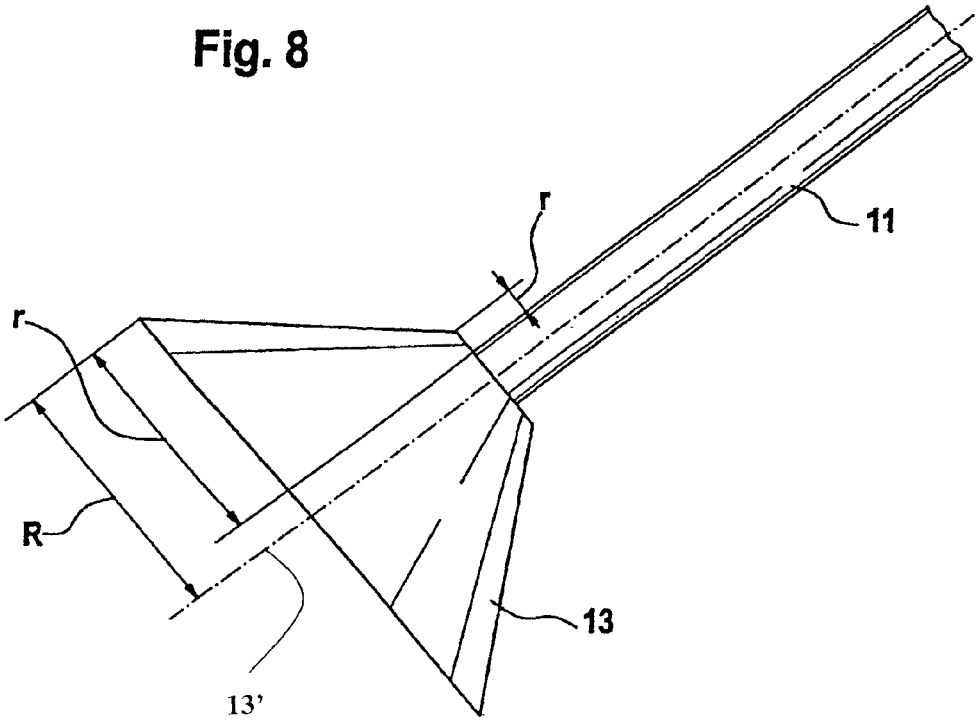

FIG. 8 shows an enlarged view of a milling head 13 with an approximately trapezoidal cross section. This figure clearly shows that the free radius r is understood to mean, on the one hand, the actual distance between the outer periphery of the end of the milling head 13 closer to the holder and the outer surface of the support 11, here a shaft. On the other hand, this term also includes the corresponding distance between the axial projection of the outer surface of the shaft support 11 and the outer periphery of the end of the milling head 13 turned away from the holder (support 11, which is a shaft). In this respect, due to the noncylindrical shape of the milling head 13, different "free radii r" result along the axial extension of the milling head 13.

In the illustrated embodiments shown in FIGS. 1 to 8, 10, and 11, the support 11 also serves as a holder for the milling head 13. Here, the free radius r is smaller than the actual radius R of the respective milling head 13.

Figure 9:
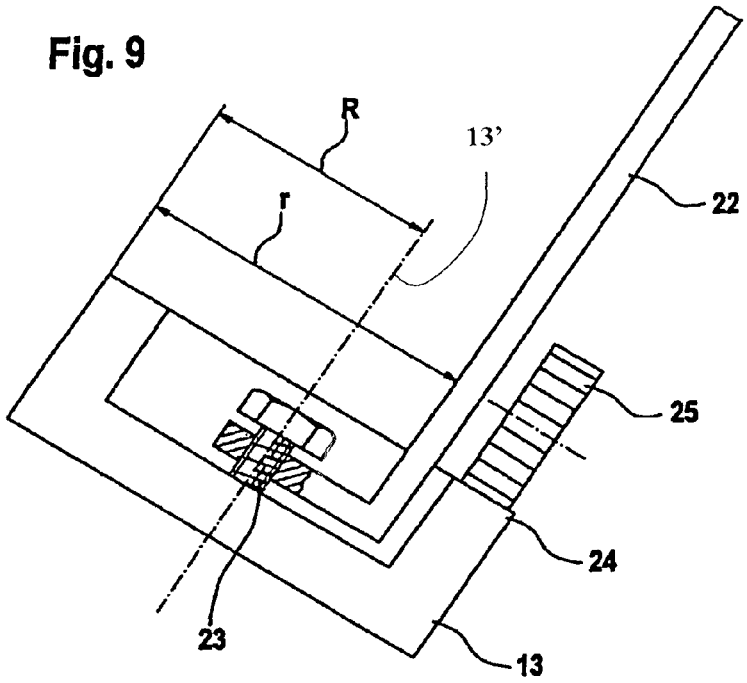

In FIG. 9, the holder is made as a separate L-shaped component, with the milling head 13 being rotatably supported on the holder 22 by means of a screw 23. On the side closer to the holder 22, a ring 24 of gear teeth has been formed on the milling head 13 that meshes with a gear wheel 25 that is driven by an unillustrated drive. Due to the special structure of the holder 22, the free radius r in this embodiment is greater than the actual radius R that extends from the rotational axis 13' of the milling head 13 such that locking grooves 9 may be formed with a greater depth.

As can be seen in FIG. 10, during formation of the locking groove 9, the milling head 13 is located with a significant portion of its free radius r in the part of the joint groove 4 that is surrounded on both sides by the groove flanks 5 and 6, with the free radius r at the same time being located completely between the long groove flank 6 and the short groove flank 5 that is elongated, i.e., extended, by a projection P in the direction parallel to the long groove flank 6.

FIG. 11 shows a position of the milling head 13 in which, during machining of the locking groove 9, a significant portion of the free radius r of the milling head 13—specifically, its entirety in this case—is located between the long groove flank 6 and the short groove flank 5 that is elongated in the projection P. On the other hand, only a small portion of the milling head 13 is located in the part of the joint groove 4 that is surrounded on both sides by the groove flanks 5 and 6.

The invention claimed is:

1. A method of forming a locking groove of a joint groove in a panel, that is part of a tongue-and-groove joint for connecting neighboring panels; the method comprising the steps of:

providing the panel having a first face and a second face;

forming the locking groove being provided in the part of the joint groove surrounded on both sides by groove flanks;

the locking groove being formed by a rotating milling tool having a drive, a milling head and a support that transmits rotation from the drive to the milling head as well as a holder for the milling head;

the milling head having a free radius at least on an end closer to the holder such that the free radius of the milling head being located entirely in the part of the joint groove surrounded on both sides by the groove flanks during formation of the locking groove.

2. A method of forming a locking groove of a joint groove in a panel, that is part of a tongue-and-groove joint for connecting neighboring panels; the method comprising the steps of:

providing the panel having a first face and a second face;

forming the locking groove being provided in the part of the joint groove surrounded on both sides by groove flanks;

the groove flanks having different lengths relative to a bottom of the joint groove so that one of the groove flanks is a short groove flank and another is a long groove flank;

the locking groove being formed by a rotating milling tool having a drive, a milling head and a support that transmits rotation from the drive to the milling head as well as a holder for the milling head;

the milling head having a free radius at least on an end closer to the holder such that the free radius being located entirely between the long groove flank and the short groove flank that extended by a projection P in the direction parallel to the long groove flank so that at least a significant portion of the free radius being surrounded on both sides by the groove flanks during formation of the locking groove.

3. A method of forming a locking groove in a groove flank of a joint groove provided in a panel, that is part of a tongue-and-groove joint for connecting neighboring panels; the method comprising the steps of:

providing the panel having a first face and a second face;

forming the locking groove being provided in the part of the joint groove that is a surrounded on both sides by groove flanks;

the groove flanks having different lengths relative to a bottom of the groove so that one of the groove flanks being a short groove flank and another being a long groove flank;

the locking groove being formed by a rotating milling tool having a drive, a milling head, and a support transmitting rotation from the drive to the milling head as well as a holder for the milling head;

the milling head having a free radius at least on an end closer to the holder such that the free radius being located entirely between the long groove flank and the short groove flank extended by a projection P in the direction parallel to the long groove flank during formation of the locking groove.

4. The method according to claim 1, wherein a rotational axis of the milling head and the drive are essentially coaxial.

5. The method according to claim 1, wherein at least one angle drive, in particular an angle gear and/or a flexible shaft, is provided between the milling head and the support.

6. The method according to claim 5, wherein, during formation of the locking groove, the angle drive is located at least significantly in the joint groove that is surrounded by both of the groove flanks.

7. A method for using of a rotating milling tool for machining a locking groove in one of two groove flanks of a joint groove in a panel; the method comprising the steps of:

providing the rotating milling tool having a drive, a milling head, and a support that transmits rotation from the drive to the milling head as well as a holder;

providing the panel having a first face and a second face, with the locking groove being formed in the part of the joint groove surrounded on both sides by the groove flanks;

an end of the milling head closer to the support having a free radius such that at least a significant portion of the free radius of the milling head being located in the part of the joint groove surrounded on both sides by the groove flanks during formation of the locking groove.

8. The method according to claim 7, wherein a rotational axis of the milling head and the drive are essentially coaxial.

9. The method according to claim 7, wherein at least one angle drive, in particular an angle gear and/or a flexible shaft, is provided between the milling head and the support.

10. The method according to claim 9, wherein, during formation of the locking groove, the angle drive is located at least significantly in the joint groove that is surrounded by both groove flanks.

11. The method according to claim 1, wherein the milling head is located entirely in the part of the joint groove surrounded on both sides by the groove flanks during formation of the locking groove.

12. The method according to claim 2, wherein the milling head is located entirely between the long groove flank and the short groove flank extended by the projection P in the direction parallel to the long groove flank.

13. The method according to claim 3, wherein the milling head is located entirely between the long groove flank and the short groove flank extended by the projection P in the direction parallel to the long groove flank.

14. The method according to claim 7, wherein the milling head is located entirely in the part of the joint groove surrounded on both sides by the groove flanks during formation of the locking groove.

15. The method according to claim 2, wherein a rotational axis of the milling head and the drive are essentially coaxial.

16. The method according to claim 2, wherein at least one angle drive, in particular an angle gear and/or a flexible shaft, is provided between the milling head and the support.

17. The method according to claim 16, wherein, during formation of the locking groove, the angle drive is located at least significantly in the joint groove that is surrounded by both of the groove flanks.

18. The method according to claim 3, wherein a rotational axis of the milling head and the drive are essentially coaxial.

19. The method according to claim 3, wherein at least one angle drive, in particular an angle gear and/or a flexible shaft, is provided between the milling head and the support.

20. The method according to claim 19, wherein, during formation of the locking groove, the angle drive is located at least significantly in the joint groove that is surrounded by both of the groove flanks.

* * * * *